US005271608A

United States Patent [19]

Kubono

[11] Patent Number: 5,271,608

[45] Date of Patent: Dec. 21, 1993

[54] ROPE DRAWING WINCH

[75] Inventor: Shigeru Kubono, Onomiti, Japan

[73] Assignee: Nikko Kizai Co., Ltd. Onomiti, Japan

[21] Appl. No.: 802,116

[22] Filed: Dec. 4, 1991

Related U.S. Application Data

[63] Continuation-in-part of Ser. No. 546,530, Jun. 29, 1990, abandoned.

[51] Int. Cl.[5] ..... B66D 1/48; B66D 1/28

[52] U.S. Cl. ..... 254/372; 254/269

[58] Field of Search ..... 254/269, 270, 271, 371, 254/372, 374, 373, 333

[56] References Cited

U.S. PATENT DOCUMENTS

| | | | |
|---|---|---|---|
| 2,292,738 | 8/1942 | Bonney | 254/333 |
| 2,681,204 | 6/1954 | Robins et al. | 254/372 |
| 2,681,954 | 6/1954 | King | 254/269 |
| 2,727,724 | 12/1955 | Biebighauser | 254/269 |
| 3,765,614 | 10/1973 | Bartl et al. | 254/333 |
| 3,776,514 | 12/1973 | Eggleton, Jr. et al. | 254/375 |
| 4,005,852 | 2/1977 | Schnitmeyer | 254/333 |
| 4,023,775 | 5/1977 | Beattie | 254/372 |
| 4,128,228 | 12/1978 | Ziegelmann | 254/334 |
| 4,157,657 | 6/1979 | Hinchman | 254/334 |
| 4,497,471 | 2/1985 | Longberg et al. | 254/372 |
| 4,722,293 | 2/1988 | Foster | 254/372 |

FOREIGN PATENT DOCUMENTS 143987 7/1950 Australia .

*Primary Examiner*—Katherine Matecki

*Attorney, Agent, or Firm*—Thomas R. Morrison

[57] ABSTRACT

A ship mounted winch is used to retrieve a continuous member for the retrieval of an anchor, a fishing net or the like. The continuous member is handled equally well whether it is a rope, a chain, a cable, or the like, even if the continuous member comprises sequential sections, for example, of rope, chain and cable connected by knots and other irregularities. This is accomplished by an annular series of notches on the central periphery of the winch drum and a central groove that transects them. Further, a detecting device detects markers attached to the continuous member that mark the end of the portion of the continuous member to be retrieved and stop the winch automatically at that point. Also, a stopping device prevents the winch drum from being pulled backwards by the weight of the retrieved object when the winch is stopped.

9 Claims, 4 Drawing Sheets

ROPE DRAWING WINCH

BACKGROUND OF THE INVENTION

This application is a continuation in part of Ser. No. 07/546,530 filed Jun. 29, 1990, now abandoned.

This invention relates to a winch, and more particularly to a winch for pulling the anchor rope of a ship, a fishing net or the like.

A winch conventionally consists of a motor whose shaft drives a drum. A rope is pulled in the rotational direction by the drum to provide a force to move the rope. While this type of winch greatly reduces the effort of retrieving a rope, it cannot be used to retrieve a chain. Also, retrieval of a rope is impeded by uneven and irregular surfaces or bulges that are caused, for example, by knots, bands or the like.

OBJECTS AND SUMMARY OF THE INVENTION

Accordingly, it is an object of the invention to provide a winch which overcomes the drawbacks of the prior art.

It is a further object of the invention to provide a winch that is equally capable of retrieving rope, chain or cable.

It is a still further object of the invention to provide a winch that is able to accommodate knots or other irregularities in the rope.

It is a still further object of the invention to provide a winch that is able to automatically stop when it senses a stop indicator on the rope or chain.

Briefly stated, the present invention provides a ship mounted winch to retrieve a continuous member for the retrieval of an anchor, a fishing net or the like. The continuous member is handled equally well whether it is a rope, chain, cable, or the like, even if the continuous member comprises sequential sections, for example, of rope, chain and cable connected by knots and other irregularities. This is accomplished by an annular series of notches on the central periphery of the winch drum and a central groove that transects them. Further, a detecting device detects markers attached to the continuous member that mark the end of the portion of the continuous member to be retrieved and stop the winch automatically at that point. Also, a stopping device prevents the winch drum from being pulled backwards by the weight of the retrieved object when the winch is stopped.

According to an embodiment of the invention, there is provided a winch for winding a continuous member comprising: a motor having an output shaft and a drum that is made up of two facing wheel bodies, whose facing sides each have slotted and beveled peripheries. When mounted on the motor output shaft, the two facing wheel bodies form a drum having a central notched and bevelled groove, so shaped to accommodate, with equal ease, rope, chain, cable or the like, as well as irregularities, such as knots in a rope According to a feature of the invention, there is provided a detecting device that tracks the path of the continuous member being retrieved, in order to stop the winch when a stop marker on the continuous member is detected.

According to a still further feature of the invention, a device is provided to strip rope from the groove of the drum as it passes to prevent the rope from jamming the winch.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
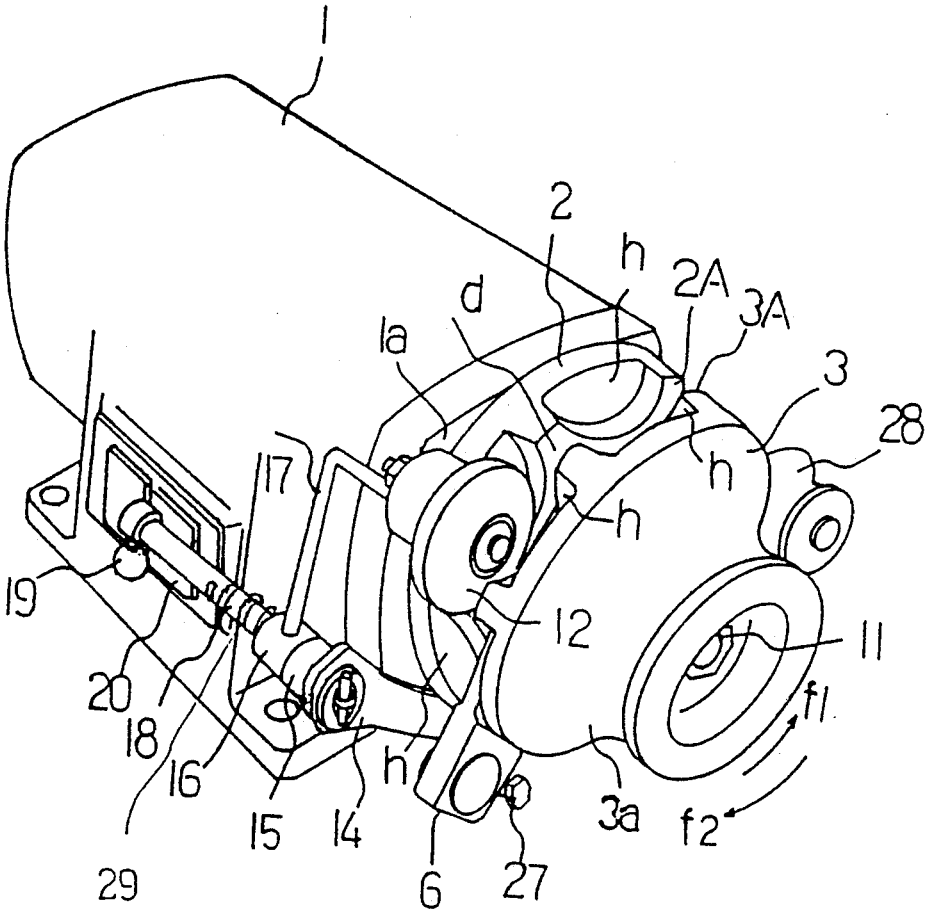
FIG. 1 is a perspective view of the winch according to an embodiment of the present invention.

FIG. 1 shows a winch, which may be installed, for example, on a boat, and which may be powered by batteries.

A motor 1 drives a drum that is made up of an inner wheel body 2 and an outer wheel body 3. Inner wheel body 2 and outer wheel body 3 are constructed of any suitable material such as, for example, a suitable synthetic resin. Inner wheel body 2 approximates a disc shape. Outer wheel body 3 has a shape approximating a conical-trapezoid. An outer surface 3*a* of outer wheel body 3 is conically shaped. Peripheries of inner facing surfaces 2A and 3A of inner wheel body 2 and outer wheel body 3, respectively, include a plurality of aligned slots h.

Inner wheel body 2 and outer wheel body 3 are assembled to form a drum that contains a plurality of notches, formed by slots h, along a central groove d. A central wheel 12 is suspended in groove d by a bent rod 17, which is connected by a collar 16 to a connecting rod 15. The connecting rod 15 is rotatably mounted to the end of a support 14. A shaft 18 is axially mounted on the collar 16 and extends along the side of the motor 1 to support a switch actuator 19 over an off pushbutton 20. A spring 29 presses the central wheel 12 into groove d and, at the same time, holds switch actuator 19 away from the off pushbutton 20.

A rope stripping member 6 extends from groove d between the inner wheel body 2 and the outer wheel body 3. The rope stripping member 6 also may be constructed of any suitable material, such as a suitable resin.

Figure 2:
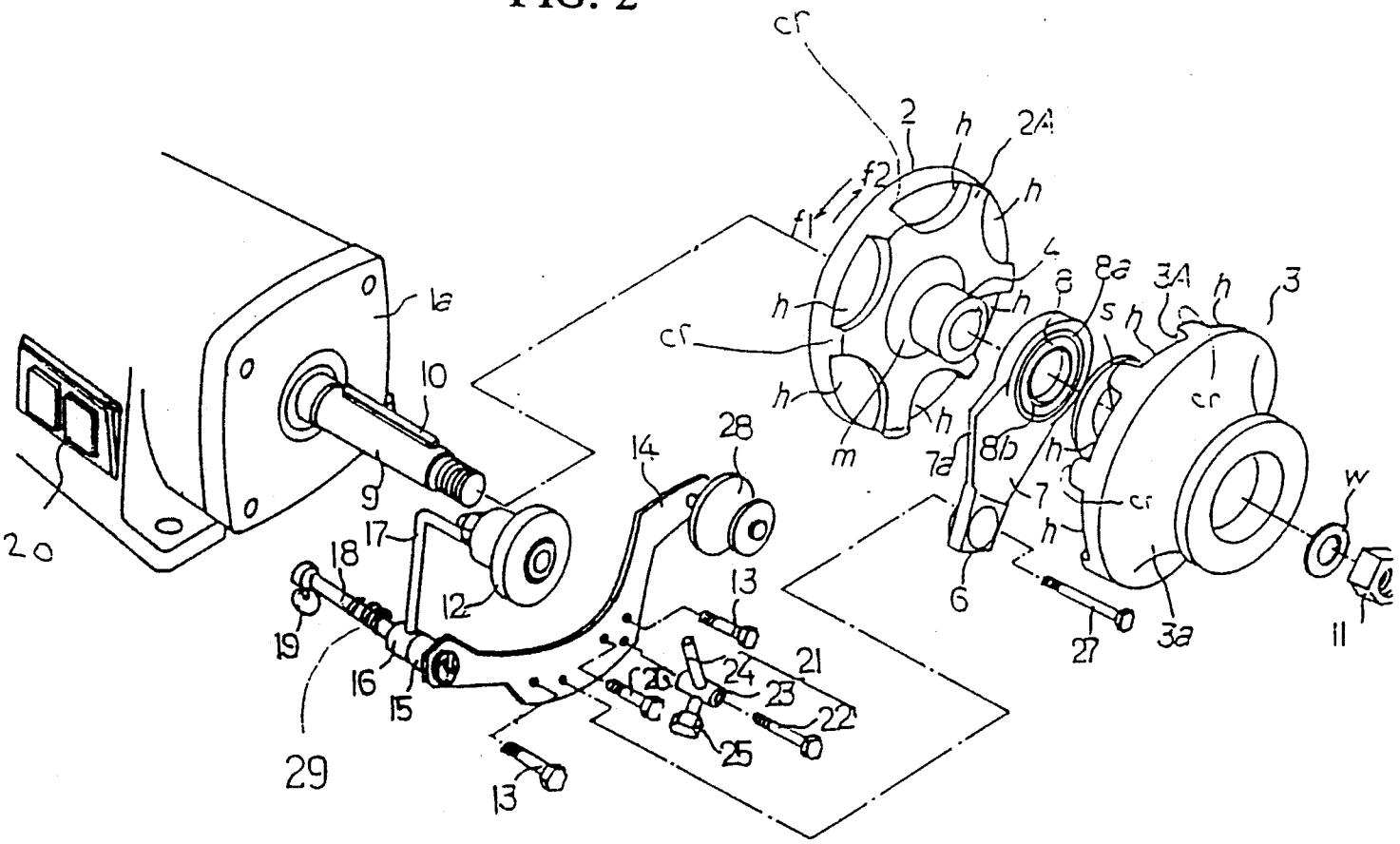
FIG. 2 is an exploded view of the winch of FIG. 1.

Referring to FIG. 2, the rope stripping member 6 is attached to one end of a flattened section 7, which presents a protrusion 7*a* on its upward facing edge. At the opposite end of section 7 is a roller or ball radial bearing 8. Radial bearing 8 is installed on a cylinder 4, which protrudes from the axis of the inner facing surface 2A of inner wheel body 2 and is surrounded by an annular groove m. One or more spacers s may also be installed on the cylinder 4 in order to adjust the width of groove d, discussed earlier with respect to FIG. 1. The structure of two separate wheel bodies 2 and 3 allows the winch to accept ropes or chains of differing thicknesses by merely arranging the distance between said two wheel bodies 2 and 3 by appropriate selection of the spacers s of differing thicknesses. There is no necessity of changing the whole wheel bodies or to provide various wheel bodies having grooves of differing widths and, therefore, this makes the winch very economical and improves the efficiency in operations.

A bolt 27, which is threaded into support 14, blocks downward rotation of the rope stripping member 6. Support 14 is a bow shaped member that is attached to a plate la of the motor 1 by two bolts 13. As previously mentioned, one end of the support 14 has mounted to it connecting rod 15. A guide wheel 28 is rotatably mounted in line with groove d at the other end of the support 14.

A wheel locking means 21 that is mounted on the support 14 comprises a rotatably mounted tube 23 that is secured to the support 14 by a shaft bolt 22. Wheel locking means 21 also comprises a locking pin 24, which is attached to the tube 23, as is a balance weight 25 that holds the locking pin 24 in position. Locking pin 24 can extend into the slots h of inner wheel body 2. A restraining bolt 26 extends from the support 14 to limit the downward motion of balance weight 25.

Figure 3:
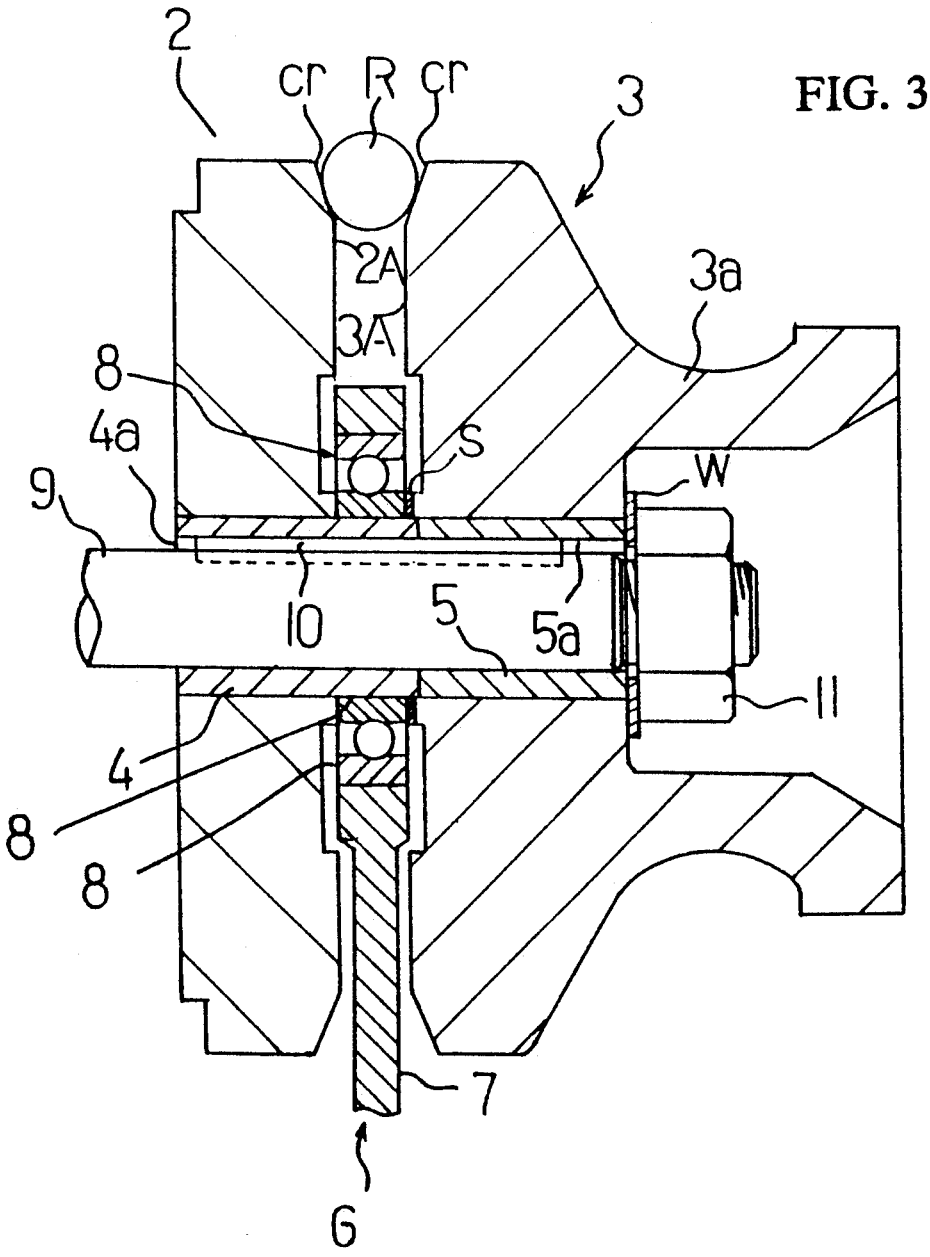
FIG. 3 is a cross section of the wheel assembly of FIG. 1.

As can be seen in FIG. 3, cylinder 4 is inserted in an axial hole in the inner wheel body 2, and protrudes from inner facing surface 2A to support the radial bearing 8 of the rope stripping member 6, and any optional spacers s that may be desired. A cylinder 5 is inserted in an axial hole of outer wheel body 3 with its inner end flush with inner facing surface 3A. An annular groove m (not indexed), similar to annular groove m that surrounds cylinder 4, surrounds cylinder 5. A slot **4*a* in cylinder 4 and a slot 5*a* in cylinder 5 mate with a shaft key 10 of an output shaft 9 to hold the inner wheel body 2 and the outer wheel body 3 correctly aligned with respect to each other to form the previously mentioned drum. A washer W and a nut 11 secure the resultant drum to the output shaft 9. The radial bearing 8 and the annular grooves m allow the rope stripping member 6** to move freely in groove d with respect to the drum. Bevels cr in the peripheries of the inner facing surfaces 2A and 3A are to accommodate a rope R. The bevels cr create an enlarged peripheral section of groove d for a rope R, while the links of a chain would fit groove d directly. The opposed bevels cr converge toward the center of the drum, facilitating insertion or "catching" of a rope R and also increase the frictional resistance for a rope R and make possible takeup of a rope R without any slippage.

In the following description, the term continuous member refers to a rope, chain, cable or the like that is retrievable by the winch.

Figure 5:
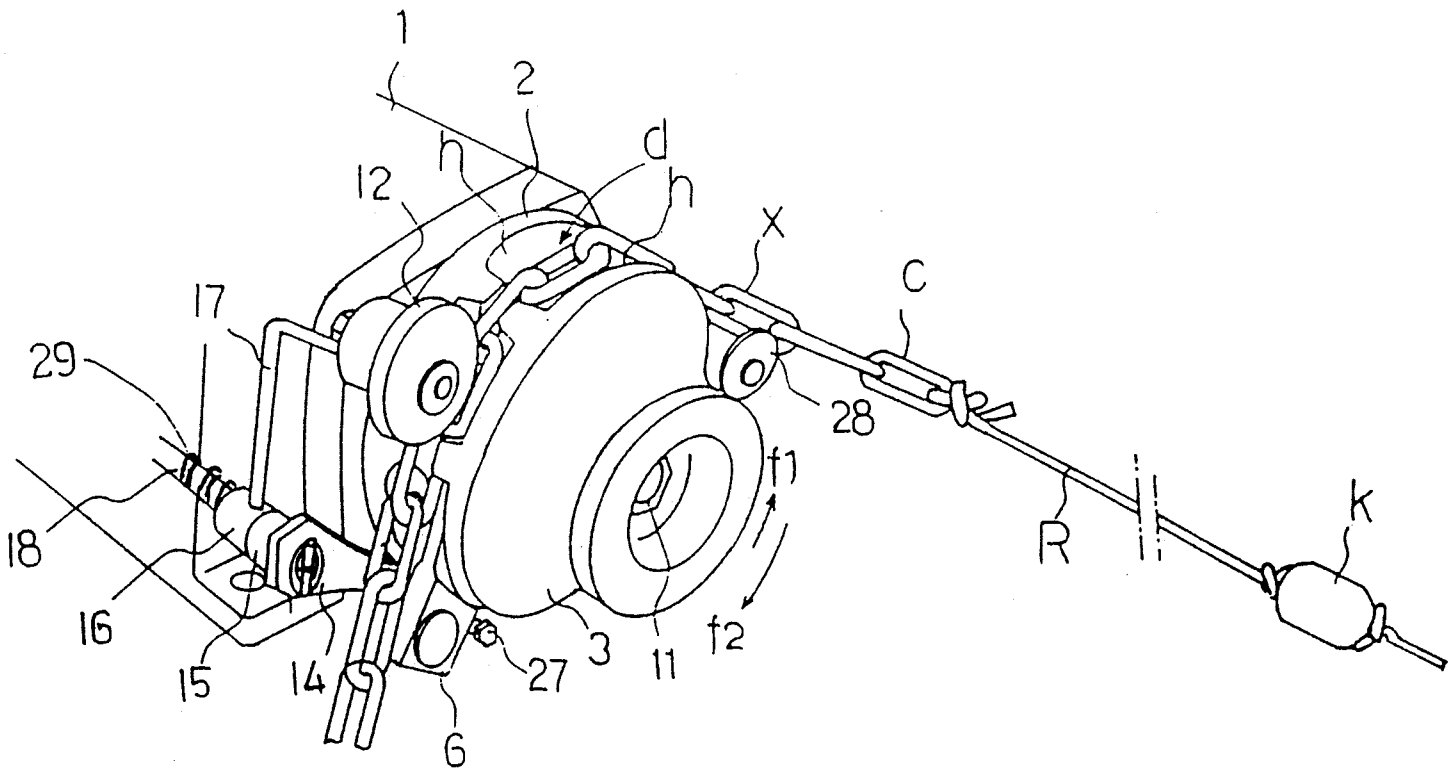
FIG. 5 is a perspective view of the winch in operation.

Referring now to FIG. 5, to operate the winch, the central wheel 12 is lifted and the continuous member to be winched is positioned in groove d between the inner wheel body 2 and the outer wheel body 3 under the central wheel 12 and over the guide wheel 28. If the continuous member to be winched is a rope R, it fits snugly in groove d. If the continuous member to be winched is a chain X, the horizontally oriented links of the chain are accommodated by the notches in groove d formed by the slots h. In the example shown in FIG. 5, the continuous member to be winched comprises a section of chain X, and a section of rope R that is secured to chain X by a knot. It should be readily apparent that stop marker k is of a size larger than any knot that the winch is intended to tolerate. After some distance along the rope, a stop marker k is secured to the section of rope R.

When a continuous member is being retrieved to stow a net, anchor or the like, power is applied to motor 1, causing the inner wheel body 2 and the outer wheel body 3 to rotate in direction f1. The continuous member is then guided into groove d by guide wheel 28 and pulled under central wheel 12 in the direction of rope stripping member 6, which separates the continuous member from groove d and the continuous member is lowered to a desired storage place by the continuing operation of the winch.

During this operation, the links C of the chain portion of the continuous member are readily accommodated by groove d because, while the vertically oriented links of chain X fit in groove d between the inner wheel body 2 and the outer wheel body 3, the horizontal links fit flat in the notches formed by the slots h on the peripheries of the inner facing surfaces 2A and 3A. When the end of chain X is reached, the rope R portion of the continuous member is readily accommodated by groove d. When the thickened stop indicator k reaches groove d it is also accommodated by a notch, but stop indicator k lifts central wheel 12 as it passes under it, causing switch actuator 19 to press against off pushbutton 20 stopping the motor 1.

Figure 4:
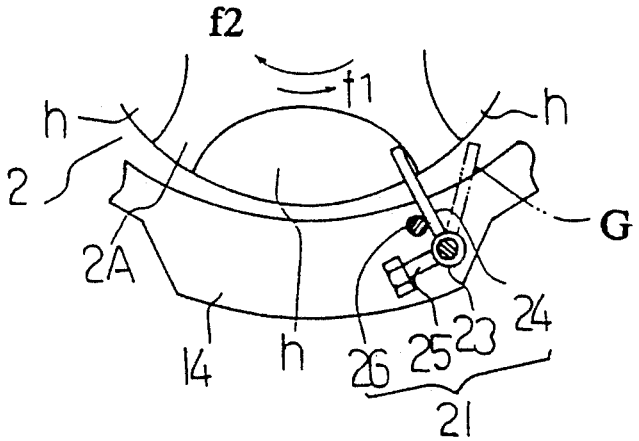
FIG. 4 is a close-up view of a portion of the wheel assembly.

Referring now to FIG. 4, when the motor 1 is stopped, the weight of the load on the winch tends to pull the inner wheel body 2 and outer wheel body 3 in the opposite direction, which is direction f2. To prevent this, the winch includes locking means 21.

During normal retrieval operation, the locking pin 24 of locking means 21 rides freely along the contour of the periphery of the inner facing surface 2A, and is held against that periphery by balance weight 25 as indicated in phantom G in FIG. 4. However, when the direction of the rotation reverses to direction f2, the first trailing edge of a slot h lifts the locking pin against retaining bolt 26, holding the locking pin in the slot h as shown in solid lines, locking the inner wheel body 2, preventing the drum from rotating in direction f2.

When the continuous member is to be let out, power is briefly applied to motor 1 which causes it to rotate the wheel bodies 2 and 3 in direction f1, relieving the pressure on locking pin 24. This allows the locking pin to be moved and held in the position shown in phantom. Therefore, when power to the motor 1 is turned off, the continuous member is pulled in direction f2 by the weight of the load.

Returning now to FIG. 5, it can be readily seen that the notches formed by the slots in inner wheel body 2 and outer wheel body 3 can be equally effective in accommodating knots or other irregularities in rope R as they are in accommodating chain X. Therefore therefore, if the continuous member is a rope, knots, splices or other protrusions in the rope do not interfere with the operation of the winch.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A winch for winding a continuous member comprising:

a motor;

an output shaft on said motor;

a drum mounted on said output shaft to rotate therewith when the motor is operated;

said drum including axially inner and outer wheel bodies;

said wheel bodies each having a surface periphery where sloping and slotted faces are alternately arranged;

said sloping and slotted face surface peripheries being spaced apart facing one another defining a groove therebetween;

said sloping face surface peripheries being adapted for sliding a rope into said groove;

means in said slotted face surface peripheries for receiving links of a chain and knots of a rope;

said means in said slotted face surfaces being further effective for receiving enlarged portions of a rope passing thereon;

means, mounted in said grooves, for stripping said continuous member from said drum; and said means for stripping including a protrusion in an outward direction from said groove.

2. A winch according to claim 1 further comprising:

means for stopping said winch automatically when a predetermined point on said continuous member is reached.

3. A winch according to claim 2, wherein said means for stopping said winch includes means for detecting said predetermined point marked by a thickening in the continuous member.

4. A winch according to claim 2 further comprising:

a central wheel for feeling the movement of said continuous member; and a movably attached arm for supporting and allowing outward motion of said central wheel.

5. A winch for winding a continuous member comprising:

a motor;

an output shaft on said motor;

a drum mounted on said output shaft to rotate therewith when the motor is operated;

said drum including inner and outer wheel bodies with facing surfaces whose peripheries are slotted and bevelled;

said wheel bodies being spaced apart facing one another with said slotted face surface peripheries defining a groove therebetween;

said output shaft including a key for aligning mating key slots in the central axis of each said wheel body for aligning said slotted face surface peripheries with each other to form a drum having a series of notches mid-longitudinally on said drum along said central groove;

said groove receiving a continuous member;

said notches receiving links of a chain; said notches receiving enlarged portions of a rope when passing thereon;

a guide wheel for guiding said continuous member to said groove and said notches;

a rope stripping member with a protrusion that points in an outward direction from the drum, mounted in said groove, for stripping said continuous member from said drum;

a detector for locating a marked point on said continuous member to stop said winch during a winding operation;

said detector including a central wheel for tracking the movement of said continuous member, a movably attached arm for supporting and allowing outward motion of said central wheel, an actuator linked to said central wheel that presses an off pushbutton on said motor for stopping rotation of said winch when said central wheel is pushed outward by a thickening in said continuous, member and a spring to prevent inadvertent operation of said off pushbutton;

a locking pin for automatically preventing said drum from reverse rotation when said winch is stopped; and said locking pin operated manually for releasing said drum for reverse rotation.

6. A winch according to claim 5, wherein said inner and outer wheel bodies are axially adjustable by sliding at least one of said inner and outer wheel bodies by means of an alignment key on said output shaft.

7. A winch according to claim 6, further comprising at least one spacer disposed on said output shaft between said inner and outer wheel bodies so as to change the space therebetween.

8. A winch for winding a continuous member comprising:

a motor;

an output shaft on said motor;

a drum mounted on said output shaft to rotate therewith when the motor is operated;

said drum including axially inner and outer wheel bodies;

said wheel bodies each having a surface periphery where sloping and slotted faces are alternatively arranged;

said sloping and slotted face surface peripheries being spaced apart facing one another defining a groove therebetween;

said sloping face surface peripheries being adapted for sliding a rope into said groove;

means in said slotted face surface peripheries for receiving links of a chain and knots of a rope;

said means in said slotted face surfaces being further effective for receiving enlarged portions of a rope passing thereon; and said inner and outer wheel bodies being axially adjustable by sliding at least one of said inner and outer wheel bodies by means of an alignment key on said output shaft.

9. A winch according to claim 8, further comprising at least one spacer disposed on said output shaft between said inner and outer wheel bodies so as to change the space therebetween.

* * * * *